US010926383B2

(12) United States Patent
Scott et al.

(10) Patent No.: US 10,926,383 B2
(45) Date of Patent: Feb. 23, 2021

(54) IMPACT TOOL

(71) Applicant: MILWAUKEE ELECTRIC TOOL CORPORATION, Brookfield, WI (US)

(72) Inventors: John S. Scott, Brookfield, WI (US); Ryan A. Dedrickson, Sussex, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 185 days.

(21) Appl. No.: 16/278,818

(22) Filed: Feb. 19, 2019

(65) Prior Publication Data

US 2019/0176303 A1 Jun. 13, 2019

Related U.S. Application Data

(63) Continuation-in-part of application No. 14/210,812, filed on Mar. 14, 2014, now abandoned.

(60) Provisional application No. 61/781,075, filed on Mar. 14, 2013.

(51) Int. Cl.

| | |
|---|---|
| ***B25B 21/02*** | (2006.01) |
| ***B25B 21/00*** | (2006.01) |
| ***B25B 23/00*** | (2006.01) |
| ***B25B 13/46*** | (2006.01) |

(52) U.S. Cl.

CPC ..... *B25B 21/026* (2013.01); *B25B 13/465* (2013.01); *B25B 21/004* (2013.01); *B25B 23/0007* (2013.01)

(58) Field of Classification Search

CPC ..... B25B 21/026; B25B 21/004; B25B 13/46; B25B 13/461; B25B 13/462; B25B 13/463; B25B 13/465; B25B 15/04; B25B 19/00; B25B 23/0007; B25D 11/04; B25D 11/066; B25D 11/068

USPC ..... 173/90–212; 81/57.13

See application file for complete search history.

(56) References Cited

U.S. PATENT DOCUMENTS

| | | | | |
|---|---|---|---|---|
| 2,711,111 | A * | 6/1955 | Brame | B25B 21/004 81/58.2 |
| 3,939,924 | A | 2/1976 | Grabovac | |
| 4,106,572 | A * | 8/1978 | Anderson | B25B 21/026 173/93 |
| 4,184,552 | A * | 1/1980 | Anderson | B25B 19/00 173/93.5 |
| 4,243,109 | A * | 1/1981 | Anderson | B25B 21/02 173/93.5 |

(Continued)

*Primary Examiner* — Dariush Seif

(74) *Attorney, Agent, or Firm* — Michael Best & Friedrich LLP

(57) ABSTRACT

An impact tool includes a housing, a motor having an output shaft defining a first axis, a drive shaft rotatably supported by the housing about a second axis oriented substantially normal to the first axis, and an impact mechanism coupled between the motor and the drive shaft and operable to impart a striking rotational force to the drive shaft. The impact mechanism includes an anvil rotatably supported by the housing and coupled to the drive shaft and a hammer coupled to the motor to receive torque from the motor and impart the striking rotational force to the anvil. A ratcheting mechanism prevents rotation of the drive shaft in a selected direction relative to the housing and includes first and second pawls movably coupled to one of the drive shaft and the housing, and ratchet teeth defined on the other of the drive shaft and the housing.

20 Claims, 7 Drawing Sheets

(56) References Cited

U.S. PATENT DOCUMENTS 4,488,459 A * 12/1984 Bailey ..... B25B 13/46 81/58.2
4,821,611 A 4/1989 Izumisawa
5,142,952 A * 9/1992 Putney ..... B25B 13/465 81/57
5,231,901 A * 8/1993 Putney ..... B25B 21/004 81/57
5,237,885 A * 8/1993 Putney ..... B25B 13/465 74/116
5,450,773 A * 9/1995 Darrah ..... B25B 13/463 81/57.39
5,537,899 A * 7/1996 Diedrich ..... B25B 13/465 192/43.1
5,738,192 A * 4/1998 Miner ..... B25B 13/463 192/43.1
5,970,825 A * 10/1999 Barnett ..... B25B 13/462 81/59.1
6,006,634 A 12/1999 Byers
6,035,745 A 3/2000 Kather
6,035,947 A * 3/2000 Chung ..... B25B 21/00 173/104
6,360,828 B1 * 3/2002 Chung ..... B25F 5/001 173/104
6,568,298 B1 * 5/2003 Zinck ..... B25B 13/465 81/57.13
6,789,447 B1 * 9/2004 Zinck ..... B25B 13/465 81/57.13
6,789,448 B2 * 9/2004 Ono ..... B25B 13/465 81/57.13
7,082,860 B2 * 8/2006 Shu-Sui ..... B25B 13/465 81/60
7,255,029 B2 8/2007 Rastegar et al.
7,410,007 B2 8/2008 Chung et al.
7,455,574 B2 11/2008 Chu et al.
7,661,337 B2 * 2/2010 Chen ..... B25B 13/463 81/62
D617,620 S * 6/2010 Yaschur ..... D8/61
7,806,198 B2 10/2010 Puzio
7,963,195 B2 * 6/2011 McRoberts ..... B25B 13/465 81/57.14
8,051,746 B2 * 11/2011 Bouchard ..... B25B 21/004 81/57.39
8,122,971 B2 2/2012 Whitmire et al.
8,146,676 B2 4/2012 Zhang et al.
8,172,713 B2 5/2012 Nakamura
8,631,880 B2 * 1/2014 Murthy ..... B25B 21/023 173/109
8,726,766 B1 * 5/2014 Wu ..... B25B 13/465 81/62
9,016,395 B2 4/2015 Scott
9,266,226 B2 * 2/2016 Timmons ..... B25B 21/02
2005/0279519 A1 * 12/2005 Clark ..... B25B 21/026 173/216
2006/0027048 A1 * 2/2006 Chen ..... B25B 21/004 81/57.39
2006/0075571 A1 * 4/2006 Lin ..... B25D 1/00 7/138
2009/0007731 A1 * 1/2009 Chen ..... B25B 13/463 81/62
2009/0301264 A1 * 12/2009 Klomp ..... B25B 15/04 81/62
2010/0000750 A1 * 1/2010 Andel ..... B25B 21/02 173/48
2010/0064864 A1 3/2010 Kobayashi
2010/0071923 A1 3/2010 Rudolph et al.
2010/0101815 A1 4/2010 Kobayashi
2011/0048179 A1 * 3/2011 Hu ..... B25B 13/468 81/63.1
2011/0139474 A1 * 6/2011 Seith ..... B23P 15/14 173/93
2012/0011971 A1 * 1/2012 Ogata ..... B25B 13/00 81/478
2012/0036968 A1 * 2/2012 Lee ..... B25B 13/465 81/63.1
2012/0037388 A1 * 2/2012 Yin ..... B25B 21/02 173/47
2012/0118596 A1 * 5/2012 Scott ..... B25B 21/026 173/98
2012/0211249 A1 * 8/2012 Seith ..... B25B 21/026 173/94
2013/0228048 A1 * 9/2013 Lai ..... B25B 13/463 81/63.1
2013/0228049 A1 * 9/2013 Shen ..... B25B 13/463 81/63.1
2013/0228354 A1 * 9/2013 Timmons ..... B25B 21/02 173/29
2013/0233585 A1 9/2013 Lin
2014/0041488 A1 * 2/2014 Chien ..... B25B 13/08 81/60
2014/0202725 A1 * 7/2014 Johnson ..... B25B 21/00 173/93
2014/0262394 A1 * 9/2014 Scott ..... B25B 23/0007 173/48
2015/0151415 A1 * 6/2015 Saitou ..... B25B 21/00 173/93
2020/0061782 A1 * 2/2020 Banholzer ..... B25B 13/465

* cited by examiner

IMPACT TOOL

CROSS-REFERENCE TO RELATED APPLICATIONS

This application is a continuation-in-part of co-pending U.S. patent application Ser. No. 14/210,812, filed on Mar. 14, 2014, which claims priority to U.S. Provisional Patent Application No. 61/781,075 filed on Mar. 14, 2013, the entire contents of both of which are incorporated herein by reference.

FIELD OF THE INVENTION

The present invention relates to power tools, and more particularly to impact tools.

BACKGROUND OF THE INVENTION

Impact tools or wrenches are typically used for imparting a striking rotational force, or intermittent applications of torque, to a workpiece. For example, impact wrenches are typically used to loosen or remove stuck fasteners (e.g., an automobile lug nut on an axle stud) that are otherwise not removable or very difficult to remove using hand tools.

SUMMARY OF THE INVENTION

The invention provides, in one aspect, an impact tool comprising a housing, a motor having an output shaft defining a first axis, a drive shaft rotatably supported by the housing about a second axis oriented substantially normal to the first axis, and an impact mechanism coupled between the motor and the drive shaft and operable to impart a striking rotational force to the drive shaft. The impact mechanism includes an anvil rotatably supported by the housing and coupled to the drive shaft and a hammer coupled to the motor to receive torque from the motor and impart the striking rotational force to the anvil. The impact tool further comprises a ratcheting mechanism operable to prevent rotation of the drive shaft in a selected direction relative to the housing. The ratcheting mechanism includes first and second pawls movably coupled to one of the drive shaft and the housing and ratchet teeth defined on the other of the drive shaft and the housing with which the first and second pawls are engageable.

The invention provides, in another aspect, an impact tool comprising a housing, a motor having an output shaft defining a first axis, a drive shaft rotatably supported by the housing about a second axis oriented substantially normal to the first axis, a gear coupled for co-rotation with the drive shaft, an impact mechanism coupled between the motor and the drive shaft and operable to impart a striking rotational force to the drive shaft, the impact mechanism including, an anvil rotatably supported by the housing and coupled to the drive shaft, the anvil including a pinion engaged with the drive shaft gear, a hammer coupled to the motor to receive torque from the motor and impart the striking rotational force to the anvil, and a spring washer exerting a preload force on the pinion to maintain the pinion meshed with the drive shaft gear.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
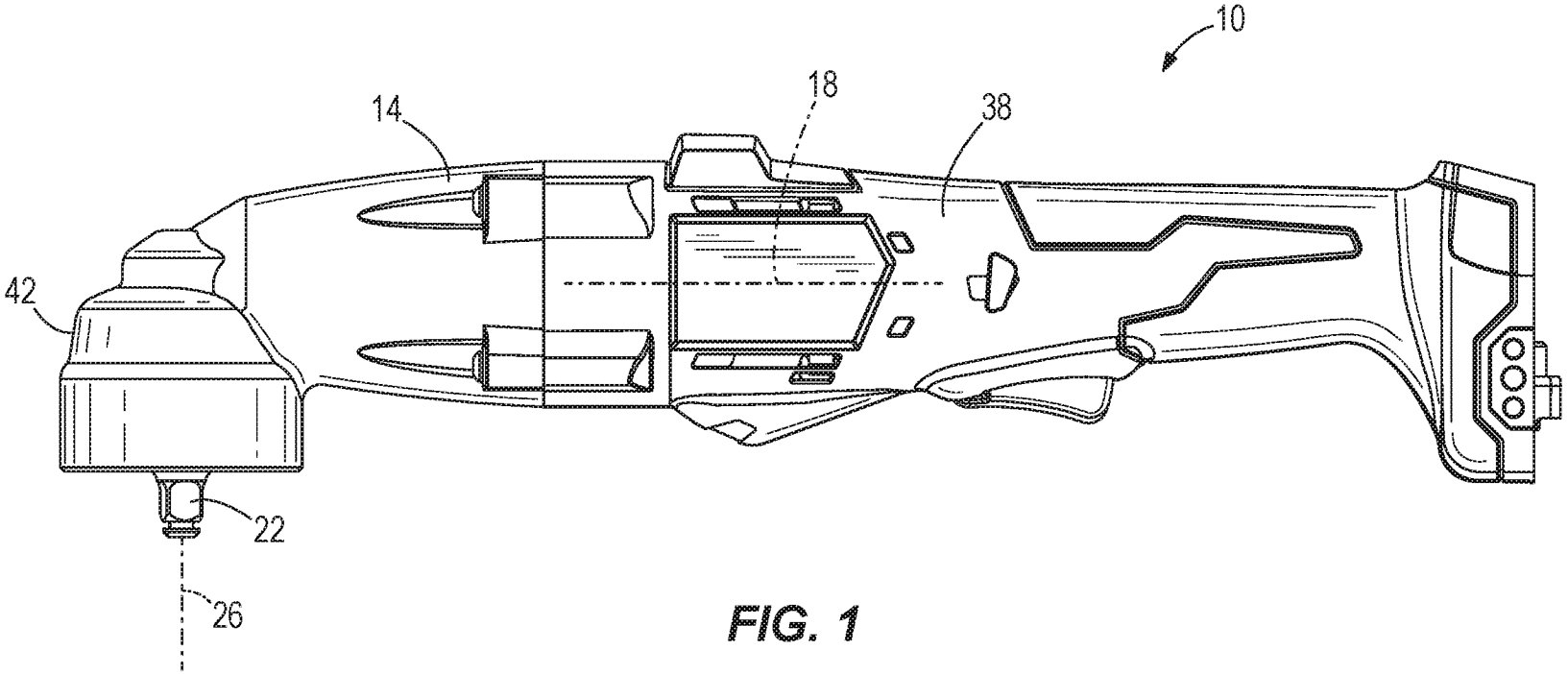
FIG. 1 is a side view of an impact tool in accordance with an embodiment of the invention.

With reference to FIG. 1, an impact tool 10 in accordance with an embodiment of the invention includes a housing 14, a motor having an output shaft 16 (FIGS. 2 and 3) defining a first axis 18, a drive shaft 22 (FIG. 1) rotatably supported by the housing 14 about a second axis 26, which is oriented substantially normal to the first axis 18, and an impact mechanism 30 (FIGS. 2 and 3) coupled between the motor and the drive shaft 22 and operable to impart a striking rotational force to the drive shaft 22. The impact tool 10 also includes a transmission 34 operably coupled to the motor and the impact mechanism 30 for transferring torque from the motor to the impact mechanism 30.

With reference to FIG. 1, the housing 14 includes a motor support portion 38 extending along the first axis 18 in which the motor is contained, and a head portion 42 in which the drive shaft 22 is rotatably supported. The motor support portion 38 is elongated and is grasped by the user of the tool 10 during operation. Although not shown, the impact tool 10 may include a battery pack electrically connected to the motor via a trigger switch (also not shown) to provide power to the motor. Such a battery pack may be a 12-volt power tool battery pack that includes three lithium-ion battery cells. Alternatively, the battery pack may include fewer or more battery cells to yield any of a number of different output voltages (e.g., 14.4 volts, 18 volts, etc.). Additionally or alternatively, the battery cells may include chemistries other than lithium-ion such as, for example, nickel cadmium, nickel metal-hydride, or the like. Alternatively, the tool 10 may include an electrical cord for connecting the motor to a remote electrical source (e.g., a wall outlet).

Figure 2:
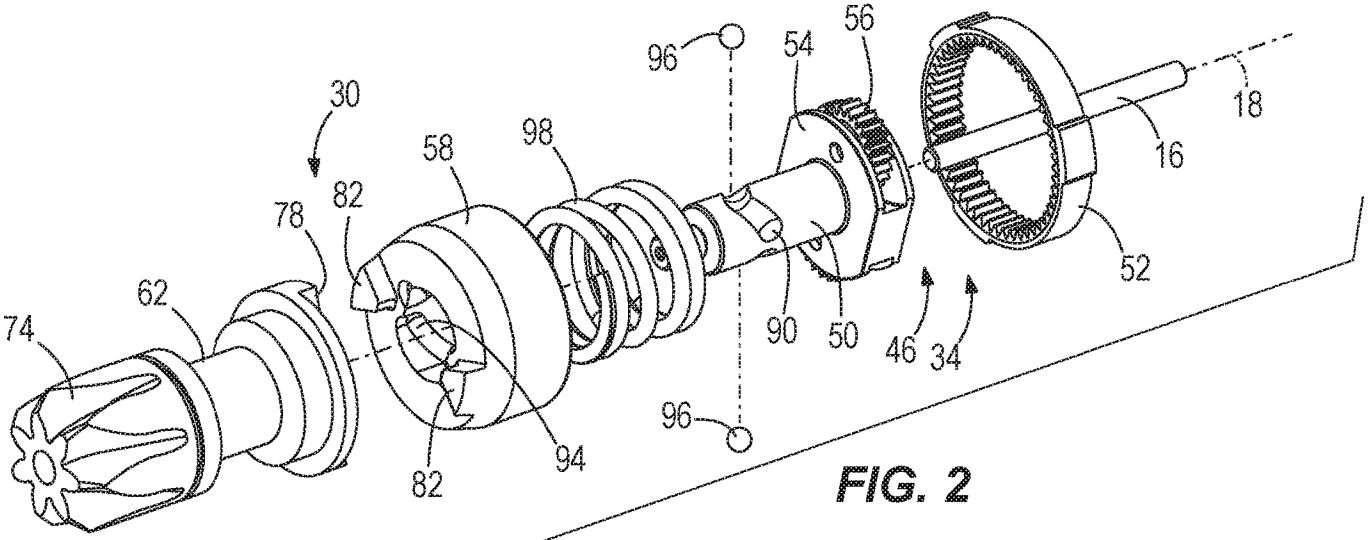
FIG. 2 is an exploded perspective view of an impact mechanism of the impact tool of FIG. 1.
Figure 3:
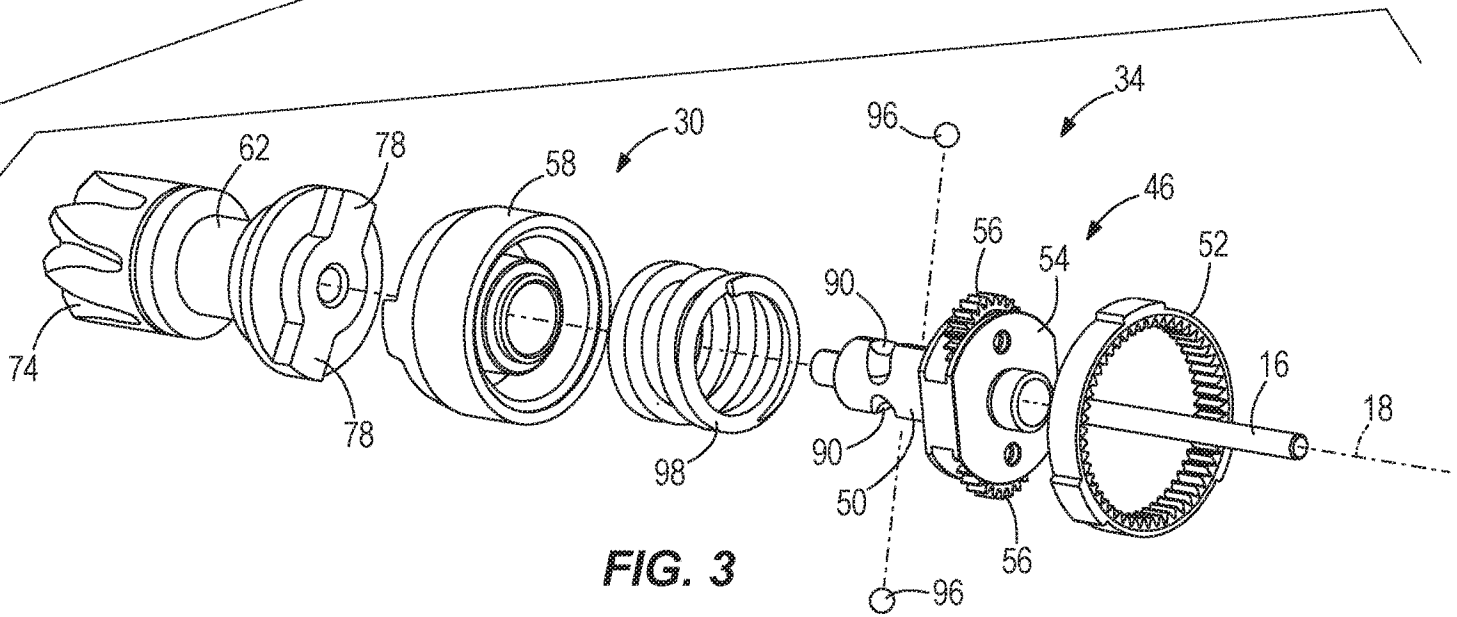
FIG. 3 is an exploded, reverse perspective view of the impact mechanism of FIG. 2.

With reference to FIGS. 2 and 3, the transmission 34 includes a single stage planetary transmission 46 and a transmission output shaft 50 functioning as the rotational output of the transmission 34. The planetary transmission 34 includes an outer ring gear 52, a carrier 54 rotatable about the first axis 18, and planet gears 56 rotatably coupled to the carrier 54 about respective axes radially spaced from the first axis 18. In the illustrated embodiment of the transmission 34, the transmission output shaft 50 is integrally formed with the carrier 54 as a single piece. Alternatively, the transmission output shaft 50 may be a separate component from the carrier 54. The outer ring gear 52 includes radially inward-extending teeth that are engageable by corresponding teeth on the planet gears 56. The outer ring gear 52 is rotationally fixed to the housing 14.

With continued reference to FIGS. 2 and 3, the impact mechanism 30 includes a hammer 58 supported on the transmission output shaft 50 for rotation with the shaft 50, and an anvil 62 coupled for co-rotation with the drive shaft 22 via a gear train 66. The anvil 62 is supported for rotation within the housing 14 by a bushing (not shown). Alternatively, a roller bearing may be utilized in place of the bushing. In the illustrated embodiment of the tool 10, the anvil 62 is integrally formed with a pinion 74 or a first gear of the gear train 66 and includes opposed, radially outwardly extending lugs 78 (FIG. 3) that are engaged with corresponding lugs 82 on the hammer 58 (FIG. 2). The pinion 74 is engaged with a ring gear 86 (FIG. 4) or a second gear of the gear train 66 which, in turn, is supported upon the drive shaft 22 for limited relative rotation therewith (FIGS. 5 and 6). As such, the drive shaft 22 is oriented substantially normal to the anvil 62.

The drive shaft 22 includes parallel flats 87 (FIG. 5) on opposite sides of the second axis 26, and the ring gear 86 includes a bore partially defined by pairs of parallel flats 88*a*, 88*b*. When it is desired to rotate the drive shaft 22 in a clockwise direction from the frame of reference of FIG. 6, the pair of flats 88*a* on the ring gear 86 are engaged with the opposed flats 87 on the drive shaft 22. Likewise, when it is desired to rotate the drive shaft 22 in a counter-clockwise direction from the frame of reference of FIG. 6, the pair of flats 88*b* on the ring gear 86 are engaged with the opposed flats 87 on the drive shaft 22. In this manner, the drive shaft 22 may be rotated relative to the ring gear 86 (in response to a torque input to the drive shaft 22) because of the clearance between the flats 87 and the individual flats 88*a*, 88*b*.

With reference to FIGS. 2 and 3, the transmission output shaft 50 includes two V-shaped cam grooves 90 equally spaced from each other about the outer periphery of the shaft 50. Each of the cam grooves 90 includes two segments that are inclined relative to the axis 18 in opposite directions. The hammer 58 has two cam grooves 94 (FIG. 2) equally spaced from each other about an inner periphery of the hammer 58. Like the cam grooves 90 in the transmission output shaft 50, each of the cam grooves 94 is inclined relative to the axis 18. The respective pairs of cam grooves 90, 94 in the transmission output shaft 50 and the hammer 58 are in facing relationship such that a cam member (e.g., a ball 96) is received within each of the pairs of cam grooves 90, 94. The balls 96 and the cam grooves 90, 94 effectively provide a cam arrangement between the transmission output shaft 50 and the hammer 58 for transferring torque between the transmission output shaft 50 and the hammer 58 between consecutive impacts of the lugs 82 upon the corresponding lugs 78 on the anvil 62. The impact mechanism 30 also includes a compression spring 98 (FIGS. 2 and 3) positioned between the hammer 58 and the carrier 54 to bias the hammer 58 toward the anvil 62. A thrust bearing (not shown) is positioned between the hammer 58 and the spring 98 to permit relative rotation between the spring 98 and the hammer 58.

Figure 4:
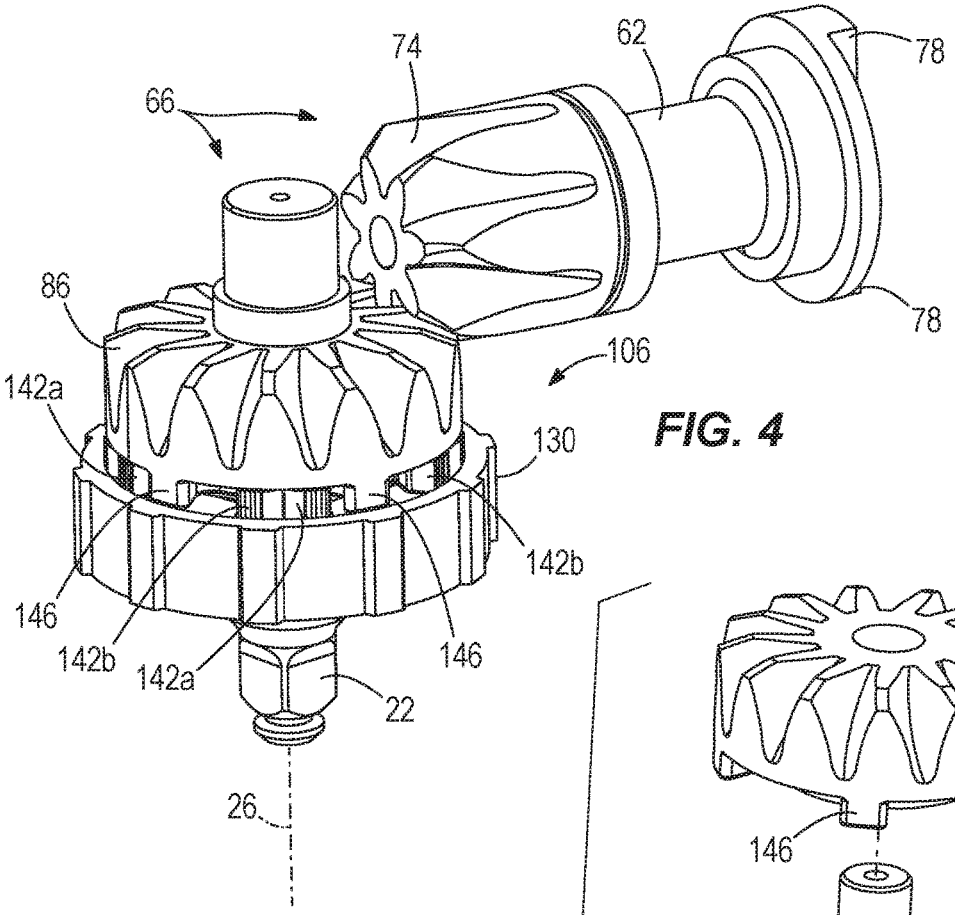
FIG. 4 is an enlarged perspective view of a locking assembly of the impact tool of FIG. 1.
Figure 5:
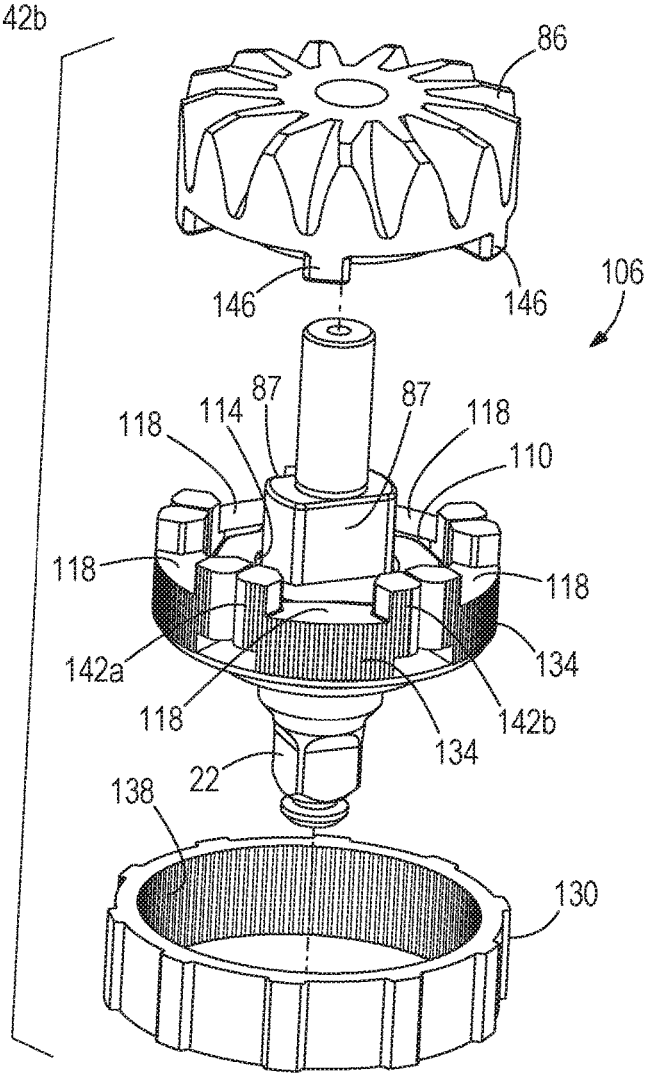
FIG. 5 is a partially exploded, perspective view of the locking assembly of FIG. 4.
Figure 6:
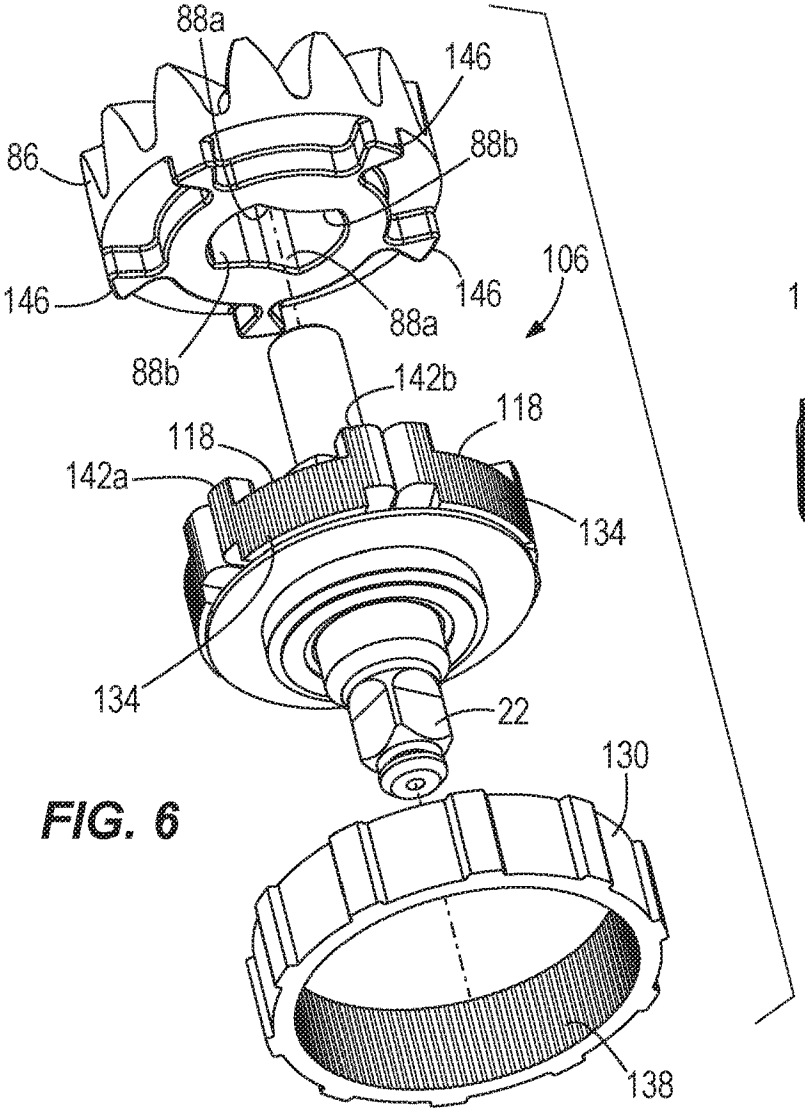
FIG. 6 is a partially exploded, reverse perspective view of the locking assembly of FIG. 4.

With reference to FIGS. 4-6, the impact tool 10 further includes a locking mechanism 106 operable to selectively lock the drive shaft 22 relative to the housing 14 in either rotational direction about the axis 26. As a result, the impact tool 10 may be used as a non-powered torque wrench when the drive shaft 22 is rotationally locked to the housing 14. The locking mechanism 106 includes a cam member 110 (FIGS. 5, 7, and 8) coupled for co-rotation with the drive shaft 22. Particularly, the cam member 110 includes a noncircular bore 114 having a shape corresponding to a noncircular section (including the flats 87) of the drive shaft 22. Alternatively, the cam member 110 may be integrally formed with the drive shaft 22 as a single piece.

The locking mechanism 106 also includes multiple followers 118 positioned between the cam member 110 and the housing 14. In the illustrated embodiment of the impact tool 10, the locking mechanism 106 includes five followers 118 corresponding with five cam lobes 122 on the cam member 110. Alternatively, the locking mechanism 106 may include a different number of followers 118 and cam lobes 122. With reference to FIGS. 4-6, the locking mechanism 106 further includes a ring 130 surrounding the followers 118 and fixed to the housing 14. Each of the followers 118 includes a radially outward-facing surface having teeth 134 (FIGS. 5-7), and the ring 130 includes a radially inward-facing surface having corresponding teeth 138 that are engageable with the teeth 134 on the followers 118. Alternatively, the teeth 134, 138 may be omitted should a sufficiently high frictional force be developed between the mating surfaces of the followers 118 and the ring 130 to resist a torque input through the drive shaft 22.

Figure 7:
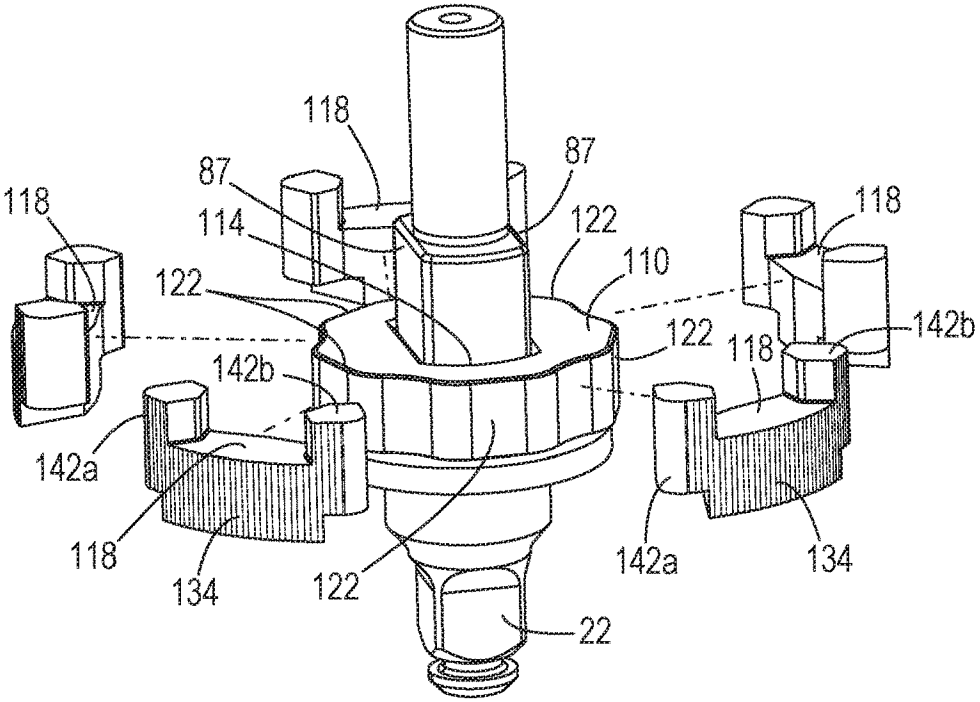
FIG. 7 is a partially exploded, perspective view of a portion of the locking assembly of FIG. 4.
Figure 8:
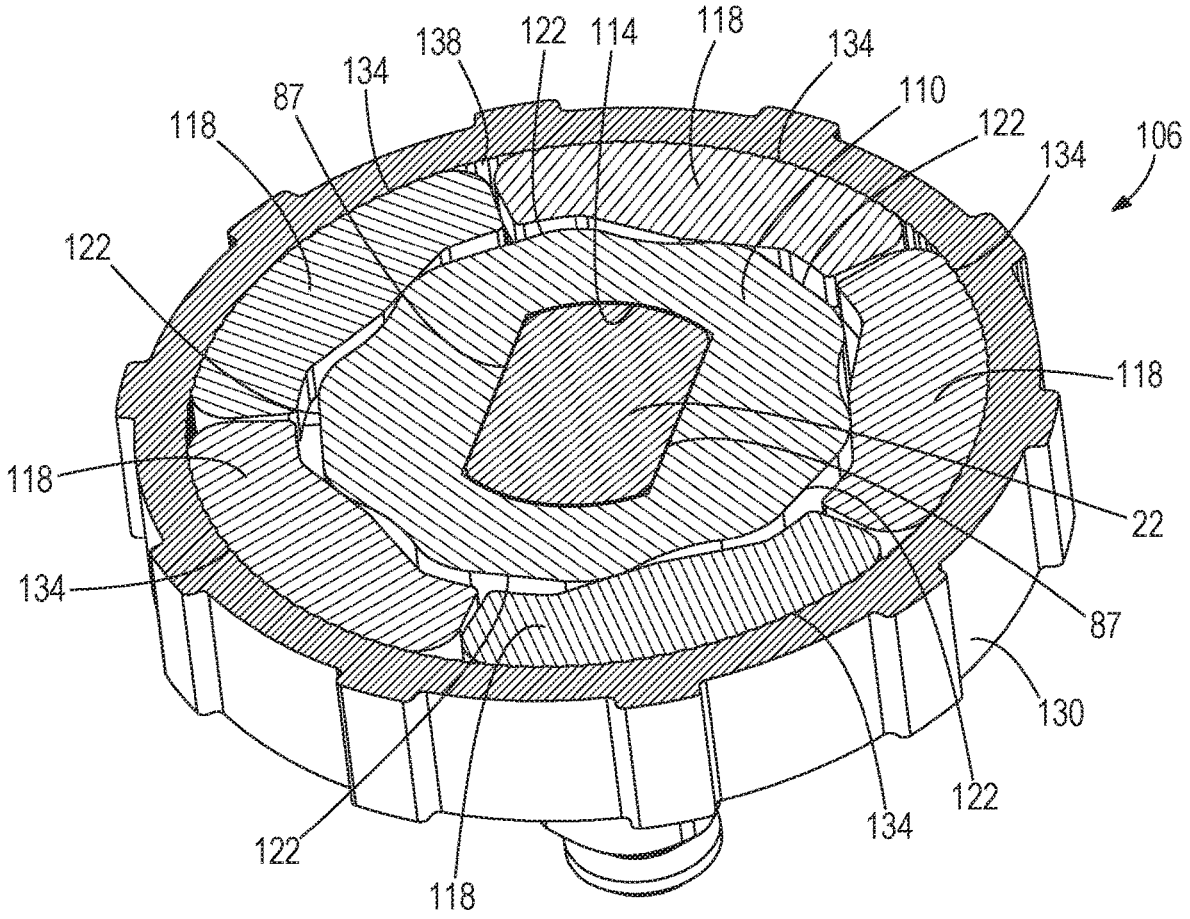
FIG. 8 is a cross-sectional view of the locking assembly of FIG. 4, taken along line 8-8.

With reference to FIG. 7, each of the followers 118 includes spaced posts 142*a*, 142*b* that are engageable with radially extending lugs 146 (FIG. 6) on the bottom of the ring gear 86. Particularly, the posts 142*a* are engaged with the lugs 146 when the ring gear 86 is rotated in a clockwise direction from the frame of reference of FIG. 4, while the posts 142*b* are engaged with the lugs 146 when the ring gear 86 is rotated in a counter-clockwise direction. Accordingly, the followers 118 co-rotate with the ring gear 86, the drive shaft 22, and the cam member 110 in response to a torque input from the anvil 62 (e.g., when the motor is activated). As a result, the followers 118 remain generally aligned with the corresponding cam lobes 122 on the cam member 110, and the lugs 146 due to their shape maintain the followers 118 in a radially inward position in which a nominal clearance exists between the followers 118 and the ring 130. Torque is therefore transferred from the anvil 62 to the drive shaft 22, via the ring gear 86, while maintaining the locking mechanism in 106 in an unlocked configuration.

In operation of the impact tool 10, the motor support portion 38 is grasped by the user of the tool 10 during operation. During operation, the motor rotates the drive shaft 22, through the transmission 34, the impact mechanism 38, and the gear train 66, in response to actuation of the trigger switch. The hammer 58 initially co-rotates with the transmission output shaft 50 and upon the first impact between the respective lugs 78, 82 of the anvil 62 and hammer 58, the anvil 62 and the drive shaft 22 are rotated at least an incremental amount provided the reaction torque on the drive shaft 22 is less than a predetermined amount that would otherwise cause the drive shaft 22 to seize. However, should the reaction torque on the drive shaft 22 exceed the predetermined amount, the drive shaft 22 and anvil 62 would seize, causing the hammer 58 to momentarily cease rotation relative to the housing 14 due to the inter-engagement of the respective lugs 78, 82 on the anvil 62 and hammer 58. The transmission output shaft 50, however, continues to be rotated by the motor. Continued relative rotation between the hammer 58 and the transmission output shaft 50 causes the hammer 58 to displace axially away from the anvil 62 against the bias of the spring 98 in accordance with the geometry of the cam grooves 90, 94 within the respective transmission output shaft 50 and the hammer 58.

As the hammer 58 is axially displaced relative to the transmission output shaft 50, the hammer lugs 82 are also displaced relative to the anvil 62 until the hammer lugs 82 are clear of the anvil lugs 78. At this moment, the compressed spring 98 rebounds, thereby axially displacing the hammer 58 toward the anvil 62 and rotationally accelerating the hammer 58 relative to the transmission output shaft 50 as the balls move within the pairs of cam grooves 90, 94 back toward their pre-impact position. The hammer 58 reaches a peak rotational speed, then the next impact occurs between the hammer 58 and the anvil 62. In this manner, a fastener may be driven by a tool bit, socket, and/or driver bit attached to the drive shaft 22 relative to a workpiece in incremental amounts until the fastener is sufficiently tight or loosened relative to the workpiece.

Should the user of the impact tool 10 decide to use the tool 10 as a non-powered torque wrench to apply additional torque to the fastener to either tighten or loosen the fastener, the user need only to manually rotate the impact tool 10 without activating the motor. The resultant reaction torque supplied by the fastener is applied to the drive shaft 22 as a torque input, causing the cam member 110 to rotate relative to the followers 118. As the cam lobes 122 are increasingly misaligned with the respective followers 118, the cam lobes 122 engage and radially displace the followers 118 toward the ring 130 until the teeth 134, 138 of the followers 118 and the ring 130 become engaged. At this time, further rotation of the drive shaft 22 and the cam member 110 relative to the followers 118 is halted and the cam lobes 122 wedge against the corresponding followers 118. Thereafter, the drive shaft 22 remains seized or fixed relative to the housing 14 during continued manual rotation of the impact tool 10. Particularly, the user of the impact tool 10 may use the motor support portion 38 of the housing 14 as a lever for manually rotating the impact tool 10 relative to the workpiece for further tightening or loosening of the fastener. The locking mechanism 106 is operable to lock the drive shaft 22 relative to the housing 14 in this manner regardless of the direction that the impact tool 10 is rotated.

Should the user of the impact tool 10 decide to switch the tool 10 back to a powered impact driver, the user needs only to activate the motor by actuating the trigger switch, thereby co-rotating the ring gear 86, the drive shaft 22, and the cam member 110. The cam lobes 122 are rotated back into alignment with the followers 118 and the lugs 146 re-engage the followers 118, thereby radially inwardly displacing the followers 118 and re-establishing the clearance between the followers 118 and the ring 130. The drive shaft 22 is then free to rotate relative to the housing 14 to resume usage of the tool 10 as an impact driver.

Figure 9:
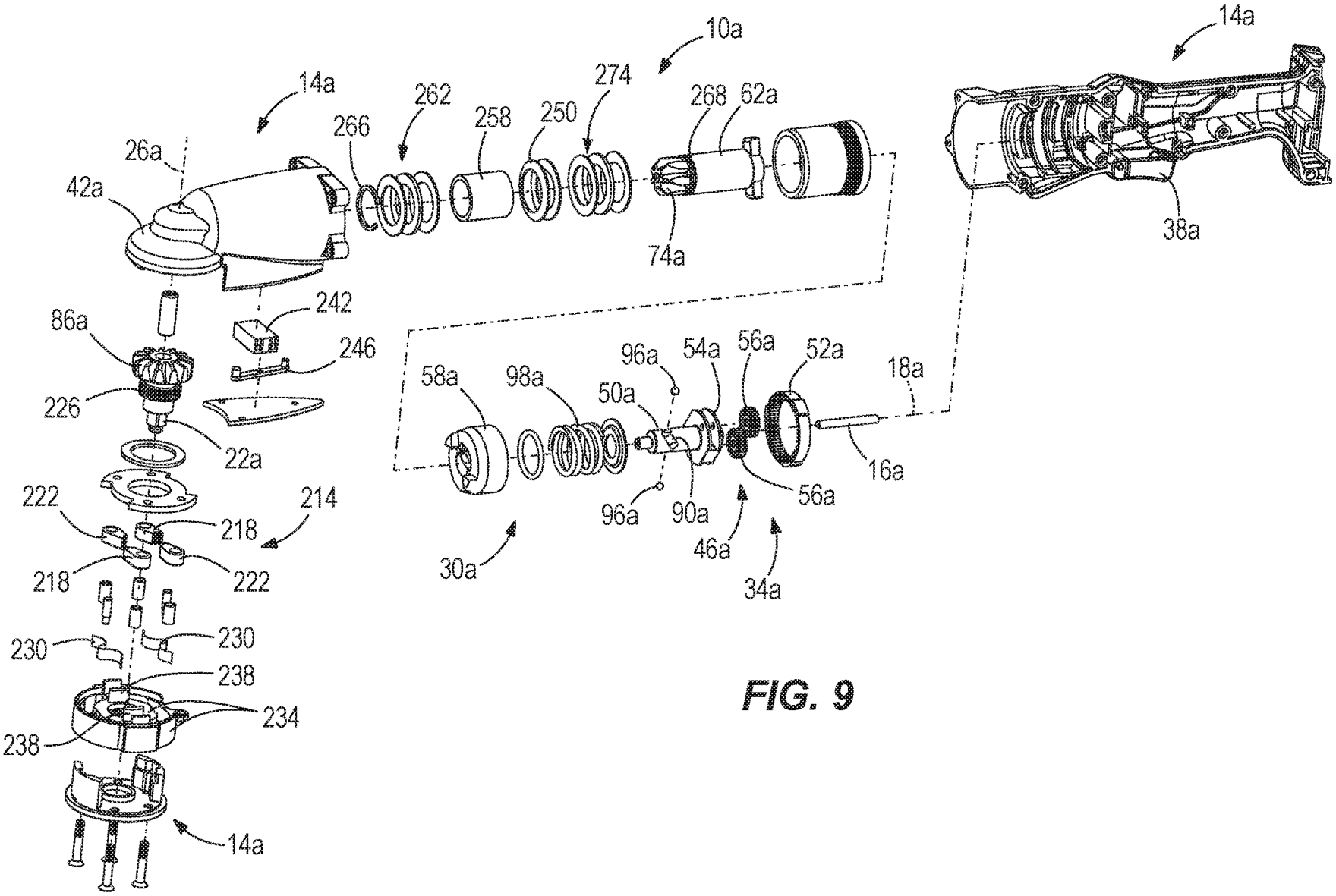
FIG. 9 is an exploded perspective view of an impact tool in accordance with another embodiment of the invention.

FIG. 9 illustrates an impact tool 10*a* in accordance with another embodiment of the invention. But for some exceptions (e.g., the ring gear 86 and the drive shaft 22 being coupled for co-rotation at all times), the impact tool 10*a* is identical to the impact tool 10 shown in FIGS. 1-3, with like features being shown with like reference numerals with the letter "a." The impact tool 10*a* includes a ratcheting mechanism 214 that is toggled between a first configuration in which the drive shaft 22*a* is prevented from rotating relative to the housing 14*a* in a first direction, and a second configuration in which the drive shaft 22*a* is prevented from rotating relative to the housing 14*a* in a second direction. In this manner, the impact tool 10*a* may be used as a non-powered torque wrench to apply additional torque to a fastener to either tighten or loosen the fastener in a similar manner as the impact tool 10 of FIGS. 1-3, depending upon which of the first and second configurations of the ratcheting mechanism 214 is chosen.

With reference to FIG. 9, the ratcheting mechanism 214 includes first and second pairs of pawls 218, 222 movably coupled to the housing 14*a* and ratchet teeth 226 defined on an outer periphery of the drive shaft 22*a* with which the pawls 218, 222 are engageable. The pairs of pawls 218, 222 are separately movable between an engaged position in which the pawls 218, 222 are engageable with the ratchet teeth 226, and a disengaged position in which the pawls 218, 222 are disengaged from the ratchet teeth 226. In the illustrated embodiment of the impact tool 10*a*, the pawls 218, 222 are pivotably coupled to the housing 14*a* and are each biased toward the engaged position by a resilient member (e.g., a leaf spring 230). Alternatively, the pawls 218, 222 may be movably coupled to the housing 14*a* in any of a number of different manners for selectively engaging the ratchet teeth 226. As a further alternative, the pawls 218, 222 may be movably coupled to the drive shaft 22*a* for deployment between the engaged and disengaged positions, and the ratchet teeth 226 may be defined on the housing 14*a*.

The ratcheting mechanism 214 also includes a switching member 234 operable to move the first pair of pawls 218 from the engaged position to the disengaged position while simultaneously moving the second pair of pawls 222 from the disengaged position to the engaged position, thereby toggling the ratcheting mechanism 214 from the first configuration to the second configuration. Likewise, the switching member 234 is operable to move the first pair of pawls 218 from the disengaged position to the engaged position while simultaneously moving the second pair of pawls 222 from the engaged position to the disengaged position, thereby toggling the ratcheting mechanism 214 from the second configuration to the first configuration. In the illustrated embodiment of the ratcheting mechanism 214, the switching member 234 includes axially extending posts 238 on opposite sides of the axis 26*a*, and the switching member 234 is rotated between two positions coinciding with the first and second configurations of the ratcheting mechanism 214. When in the first configuration of the ratcheting mechanism 214, the posts engage the second pair of pawls 222 to maintain the pawls 222 in the disengaged position. The pawls 218, therefore, are biased inward by the springs 230 into engagement with the ratchet teeth 226 (i.e., the engaged position). Likewise, when in the second configuration of the ratcheting mechanism 214, the posts 238 engage the first pair of pawls 218 to maintain the pawls 218 in the disengaged position. The pawls 222, therefore, are biased inward by the springs 230 into engagement with the ratchet teeth 226 (i.e., the engaged position). Alternatively, the switching member 234 may include different structure for moving the first and second pairs of pawls 218, 222 between their respective engaged and disengaged positions.

With continued reference to FIG. 9, the impact tool 10 includes a switch 242 electrically connected with the motor for setting the rotational direction of the motor. Particularly, the switch is toggled between a first position for operating the motor in a first direction (e.g., forward), and a second position for operating the motor in an opposite, second direction (e.g., reverse). The impact tool 10 also includes a linkage 246 extending between the switching member 234 of the ratcheting mechanism 214 and the switch 242. As a result, the linkage 246 toggles the switch 242 between the first and second positions in response to the ratcheting mechanism 214 being toggled between the first and second configurations. Therefore, it is ensured that the motor cannot rotate the drive shaft 22*a* in a direction that is otherwise prevented by engagement of one of the pairs of pawls 218, 222 with the ratchet teeth 226 on the drive shaft 22*a*.

Should the user of the impact tool 10*a* decide to use the tool 10*a* as a non-powered torque wrench to apply additional torque to a fastener to tighten the fastener, the user of the impact tool 10*a* may grasp the motor support portion 38*a* of the housing 14*a* as a lever for manually rotating the impact tool 10*a* relative to the workpiece for further tightening the fastener. Particularly, the user of the impact tool 10*a* would first rotate the switching member 234 to a position in which the pawls 218 engage the ratchet teeth 226 on the drive shaft 22*a*, and then rotate the housing 14*a* (and therefore the pawls 218) in a clockwise direction about the axis 26*a* (from the frame of reference of FIG. 9). The pawls 218 cannot deflect over the ratchet teeth 226 when attempting to rotate the housing 14*a* relative to the drive shaft 22*a* in this direction. Rather, the pawls 218 jam against the ratchet teeth 226 on the drive shaft 22*a* for rotationally locking the drive shaft 22*a* to the housing 14*a*, allowing the user to apply leverage to the motor support portion 38*a* of the housing 14*a* for manually rotating the impact tool 10*a* in a clockwise direction for tightening a fastener. The pawls 218 will, however, ratchet over the ratchet teeth 226 in response to the user rotating the impact tool 10*a* in a counter-clockwise direction to reorient the housing 14*a* relative to the drive shaft 22*a*.

Should the user of the impact tool 10*a* decide to resume using the tool 10*a* as a powered impact driver, the user needs only to activate the motor by depressing the trigger switch. The pawls 218 will ratchet over the ratchet teeth 226 in response to the motor rotating the drive shaft 22*a* in a counter-clockwise direction.

Likewise, should the user of the impact tool 10*a* decide to use the tool 10*a* as a non-powered torque wrench to apply additional torque to a fastener to loosen the fastener, the user of the impact tool 10*a* may grasp the motor support portion 38*a* of the housing 14*a* as a lever for manually rotating the impact tool 10*a* relative to the workpiece for further loosening the fastener. Particularly, the user of the impact tool 10*a* would first rotate the switching member 234 to a position in which the pawls 222 engage the ratchet teeth 226 on the drive shaft 22*a*, and then rotate the housing 14*a* (and therefore the pawls 222) in a counter-clockwise direction about the axis 26*a* (from the frame of reference of FIG. 9). The pawls 222 cannot deflect over the ratchet teeth 226 when attempting to rotate the housing 14*a* relative to the drive shaft 22*a* in this direction. Rather, the pawls 222 jam against the ratchet teeth 226 on the drive shaft 22*a* for rotationally locking the drive shaft 22*a* to the housing 14*a*, allowing the user to apply leverage to the motor support portion 38*a* of the housing 14*a* for manually rotating the impact tool 10*a* in a counter-clockwise direction for loosening a fastener. The pawls 222 will, however, ratchet over the ratchet teeth 226 in response to the user rotating the impact tool 10*a* in a clockwise direction to reorient the housing 14*a* relative to the drive shaft 22*a*.

Should the user of the impact tool 10*a* decide to resume using the tool 10*a* as a powered impact driver, the user needs only to activate the motor by depressing the trigger switch. The pawls 222 will ratchet over the ratchet teeth 226 in response to the drive shaft 22*a* being rotated in a clockwise direction by the motor.

Figure 10:
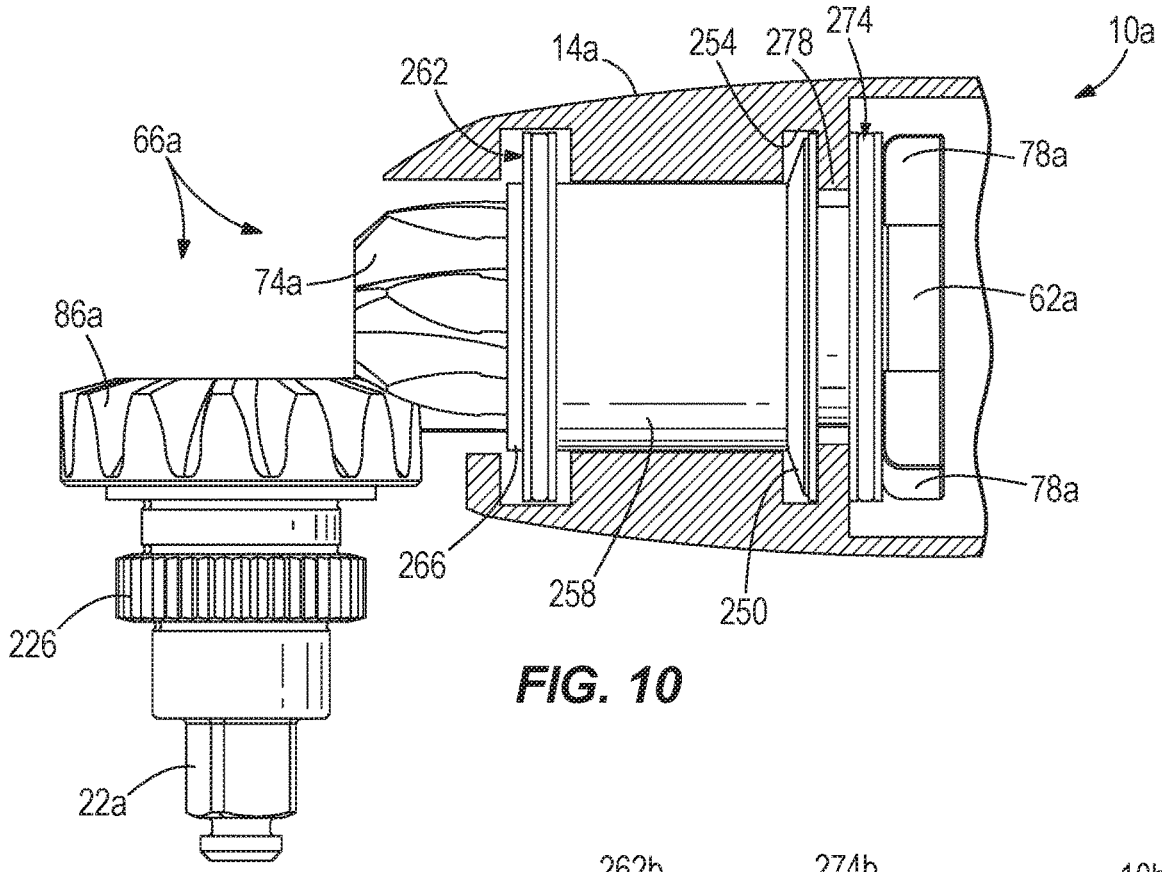
FIG. 10 is an assembled, cutaway side view of a portion of the impact tool of FIG. 9.

With reference to FIG. 10, the impact tool 10*a* further includes a spring washer 250 that exerts a preload force on the pinion 74*a* to maintain the pinion 74*a* meshed with the ring gear 86*a* on the drive shaft 22*a*. The spring washer 250 is located within an annular groove 254 in the housing 14*a* and exerts the preload force on the pinion 74*a* via a bushing 258 that rotatably supports the anvil 62*a* within the housing 14*a*, a thrust bearing assembly 262, and a retainer ring 266 positioned within a groove 268 (FIG. 9) in the anvil 62*a*. In operation of the impact tool 10*a*, the stiffness of the spring washer 250 is sufficiently high to push the anvil 62*a* to the left from the frame of reference of FIG. 10 and take up any clearances resulting from tolerance build-up between interfacing components of the impact tool 10*a*. A second thrust washer assembly 274 is arranged between the lugs 78*a* of the anvil 62*a* and a radially inward-extending circumferential flange 278 of the housing 14*a*, such that the lugs 78*a* can bear against the second thrust washer assembly 274 as the spring washer 250 pushes the anvil 62 to the left of the frame of reference of FIG. 10. In the embodiment of FIG. 10, the annular groove 254 is arranged adjacent the flange 278. In the illustrated embodiment of the impact tool 10*a*, the spring washer 250 is configured as a conical spring washer (e.g., a Belleville washer). Alternatively, the spring washer 250 may include any of a number of different configurations.

Figure 11:
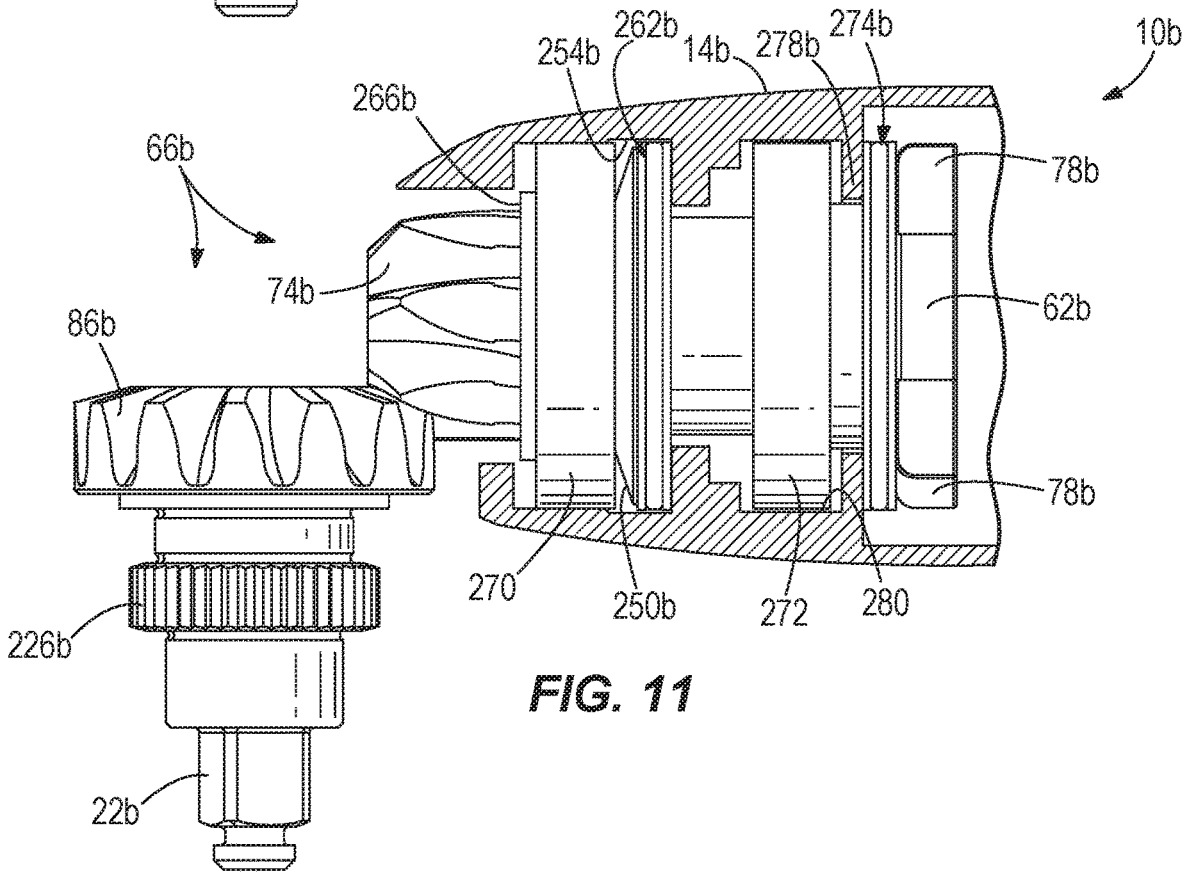
FIG. 11 is an assembled, cutaway side view of a portion of an impact tool in accordance with yet another embodiment of the invention.

FIG. 11 illustrates an impact tool 10*b* in accordance with another embodiment of the invention. But for some exceptions, the impact tool 10*b* is identical to the impact tool 10*a* shown in FIG. 9, with like features being shown with like reference numerals with the letter "b." Rather than using a single, elongated bushing 258 like that shown in FIG. 10, the impact tool 10*b* includes first, front-most, and second, rear-most, shorter bushings 270, 272 for rotatably supporting the anvil 62*b* within the housing 14*b*. The spring washer 250*b* bears directly against the first bushing 270 which, in turn, bears against the retainer ring 266*b*. In the embodiment of FIG. 11, the spring washer 250*b* is seated against the first thrust bearing assembly 262*b*. The second bushing 272 is arranged in a second annular groove 280 that is separate from the first annular groove 254*b* and adjacent the flange 278*b*.

Various features of the invention are set forth in the following claims.

What is claimed is:

1. An impact tool comprising:

a housing;

a motor having an output shaft defining a first axis;

a drive shaft rotatably supported by the housing about a second axis oriented substantially normal to the first axis;

an impact mechanism coupled between the motor and the drive shaft and operable to impart a striking rotational force to the drive shaft, the impact mechanism including an anvil rotatably supported by the housing and coupled to the drive shaft, and a hammer coupled to the motor to receive torque from the motor and impart the striking rotational force to the anvil; and a ratcheting mechanism operable to prevent rotation of the drive shaft in a selected direction relative to the housing, the ratcheting mechanism including first and second pawls movably coupled to one of the drive shaft and the housing, and ratchet teeth defined on the other of the drive shaft and the housing with which the first and second pawls are engageable.

2. The impact tool of claim 1, wherein the ratcheting mechanism is toggled between a first configuration in which the drive shaft is prevented from rotating relative to the housing in a first direction, and a second configuration in which the drive shaft is prevented from rotating relative to the housing in a second direction.

3. The impact tool of claim 2, wherein the ratcheting mechanism is toggled from the first configuration to the second configuration in response to reversing a rotational direction of the motor output shaft relative to the housing.

4. The impact tool of claim 2, wherein the drive shaft is rotatable relative to the housing in the second direction when the ratcheting mechanism is in the first configuration in response to a torque input from the anvil, and wherein the drive shaft is rotatable relative to the housing in the first direction when the ratcheting mechanism is in the second configuration in response to a torque input from the anvil.

5. The impact tool of claim 2, wherein the housing includes a first housing portion extending along the first axis, and a second housing portion extending along the second axis.

6. The impact tool of claim 5, wherein the first housing portion is longer than the second housing portion to facilitate usage of the impact tool as a non-powered torque wrench for applying torque in the first direction when the ratcheting mechanism is in the second configuration, and applying torque in the second direction when the ratcheting mechanism is in the first configuration.

7. The impact tool of claim 2, further comprising a switch electrically connected with the motor, wherein the switch is toggled between a first position for operating the motor in a first direction, and a second position for operating the motor in an opposite, second direction.

8. The impact tool of claim 7, further comprising a linkage between the ratcheting mechanism and the switch, wherein the linkage toggles the switch to one of the first position or the second position in response to the ratcheting mechanism being toggled to the first configuration, and wherein the linkage toggles the switch to the other of the first position or the second position in response to the ratcheting mechanism being toggled to the second configuration.

9. The impact tool of claim 8, further comprising a switching member operable to toggle the ratcheting mechanism between the first configuration and the second configuration, and wherein the linkage extends between the switching member and the switch.

10. The impact tool of claim 1, wherein the ratcheting mechanism includes third and fourth pawls movably coupled to the one of the drive shaft and the housing to which the first and second pawls are moveably coupled, and wherein the third and fourth pawls are engagable with the ratchet teeth.

11. The impact tool of claim 10, wherein the ratcheting mechanism includes a resilient member for biasing at least one of the first and second pawls toward their respective engaged positions.

12. The impact tool of claim 11, wherein the ratcheting mechanism includes a switching member operable to move the first pawl from the engaged position to the disengaged position, thereby toggling the ratcheting mechanism from the first configuration to the second configuration.

13. The impact tool of claim 1, wherein the first pawl is movable between an engaged position for engaging the ratchet teeth in the first configuration of the ratchet mechanism and a disengaged position, and wherein the second pawl is movable between an engaged position for engaging the ratchet teeth in the second configuration of the ratchet mechanism and a disengaged position.

14. The impact tool of claim 13, wherein the switching member is operable to move the second pawl from the engaged position to the disengaged position, thereby toggling the ratcheting mechanism from the second configuration to the first configuration.

15. The impact tool of claim 1, further comprising:

a transmission shaft having a first cam groove, and a cam member at least partially received within the first cam groove and a second cam groove within the hammer, wherein the cam member imparts axial movement to the hammer relative to the transmission shaft in response to relative rotation between the transmission shaft and the hammer.

16. The impact tool of claim 1, wherein the anvil includes a first gear, and wherein the drive shaft includes a second gear engaged with the first gear for transferring torque to the drive shaft.

17. The impact tool of claim 1, further comprising:

a drive shaft gear coupled for co-rotation with the drive shaft, a pinion on the anvil engaged with the drive shaft gear, and a spring washer exerting a preload force on the pinion to maintain the pinion meshed with the drive shaft gear.

18. The impact tool of claim 17, further comprising a first bushing rotatably supporting the anvil within the housing.

19. The impact tool of claim 18, further comprising a second bushing rotatably supporting the anvil within the housing, wherein the second bushing is farther from the pinion than the first bushing.

20. The impact tool of claim 18, further comprising a retainer ring arranged in a groove on the anvil, wherein the first bushing is arranged between the spring washer and the retainer ring, such that the spring washer exerts the preload force on the pinion via the first bushing and the retainer ring.

* * * * *